US011780655B2

(12) United States Patent
Chae

(10) Patent No.: US 11,780,655 B2
(45) Date of Patent: Oct. 10, 2023

(54) STRUCTURE FOR ONE-TOUCH OPENING/CLOSING OF CAP AND CONTAINER

(71) Applicant: Dong Seuk Chae, Seoul (KR)

(72) Inventor: Dong Seuk Chae, Seoul (KR)

( * ) Notice: Subject to any disclaimer, the term of this patent is extended or adjusted under 35 U.S.C. 154(b) by 0 days.

(21) Appl. No.: 17/771,110

(22) PCT Filed: Nov. 2, 2020

(86) PCT No.: PCT/KR2020/015115
§ 371 (c)(1),
(2) Date: Apr. 22, 2022

(87) PCT Pub. No.: WO2021/101122
PCT Pub. Date: May 27, 2021

(65) Prior Publication Data

US 2022/0371791 A1 Nov. 24, 2022

(30) Foreign Application Priority Data

Nov. 18, 2019 (KR) ..... 10-2019-0148106

(51) Int. Cl.
*B65D 45/32* (2006.01)
*B65D 41/46* (2006.01)

(52) U.S. Cl.
CPC ..... *B65D 45/322* (2013.01); *B65D 41/46* (2013.01); *B65D 2251/205* (2013.01)

(58) Field of Classification Search
CPC . B65D 45/322; B65D 41/46; B65D 2251/205
(Continued)

(56) References Cited

U.S. PATENT DOCUMENTS 4,192,428 A * 3/1980 Segmuller ..... B65D 51/18 215/354
4,359,166 A 11/1982 Dubach
5,678,718 A 10/1997 Morris et al.

FOREIGN PATENT DOCUMENTS

KR 20-0385497 Y1 5/2005
KR 10-0757795 B1 9/2007
(Continued)

OTHER PUBLICATIONS

Search Report, dated Jan. 5, 2021, for International Application No. PCT/KR2020/015115.
(Continued)

*Primary Examiner* — J. Gregory Pickett
*Assistant Examiner* — Niki M Eloshway
(74) *Attorney, Agent, or Firm* — LRK Patent Law Firm

(57) ABSTRACT

A structure for one-touch opening/closing of a cap and a container, which simplifies one-touch opening/closing structure, prevents the cap from being self-opened due to internal or external pressure of the container, and facilitates smooth opening of the cap, is provided. The structure includes: a container including an the inlet and an engaging ledge formed on an outer surface; and a cap including a sealing portion and a cover portion, the sealing portion including a hook formed thereon corresponding to the engaging ledge, and opening the inlet of the container while ascending and closing the inlet of the container while descending as the hook is put on the engaging ledge, the cover portion being formed as a barrel-shaped body for the sealing portion, whereby productivity and assemblability of a product are improved, convenience of use is improved, and product quality and market competitiveness are maximized.

7 Claims, 10 Drawing Sheets

(58) Field of Classification Search
USPC ..... 215/272
See application file for complete search history.

(56) References Cited

FOREIGN PATENT DOCUMENTS

| | | | | | |
|---|---|---|---|---|---|
| KR | 10-1121860 | B1 | | 3/2012 | |
| KR | 10-2096794 | B1 | | 4/2020 | |
| KR | 2096794 | B1 | * | 4/2020 | ..... B65D 41/46 |
| WO | WO-2005009852 | A1 | * | 2/2005 | ..... B65D 41/02 |
| WO | WO-2007148916 | A1 | * | 12/2007 | ..... B65D 45/322 |
| WO | WO-2010151009 | A2 | * | 12/2010 | ..... B65D 45/322 |

OTHER PUBLICATIONS

Written Opinion, dated Jan. 5, 2021, for International Application No. PCT/KR2020/015115.

* cited by examiner

STRUCTURE FOR ONE-TOUCH OPENING/CLOSING OF CAP AND CONTAINER

CROSS-REFERENCE TO RELATED APPLICATIONS

The present application is a U.S. National Phase entry from International Application No. PCT/KR2020/015115, filed on Nov. 2, 2020, which claims priority to Korean Patent Application No. 10-2019-0148106, filed on Nov. 18, 2019, the disclosure of which is incorporated by reference herein in their entirety.

TECHNICAL FIELD

The present inventive concept relates to a structure for one-touch opening/closing of a cap and a container, and more particularly, to a structure for one-touch opening/closing of a cap and a container, which simplifies a conventional one-touch opening/closing structure to improve moldability and productivity, prevents, with high reliability, the cap from being self-opened due to the internal or external pressure of the container during sealing, and facilitates soft and smooth opening of the cap, whereby productivity and assemblability of a product may be greatly improved because sealing is made by only an operation of pressing a cap that is integrally injection-molded through a simpler structure, user's convenience of use may be improved because the cap can be easily opened with one hand only, and product quality and market competitiveness may be maximized because whether the cap is opened for the first time can be easily checked.

BACKGROUND ART

Generally, containers and caps are widely used to store, transport, or distribute various liquids including beverages.

Structures for opening/closing containers and caps are largely divided into a screw method and a push & pull type one-touch method.

First, in an opening/closing structure of a screw method, a screw thread is formed on each of a container and a cap, and thus, opening/closing of the cap is made by turning the cap with one hand while holding the container with the other hand.

Such an opening/closing structure of a screw method has an advantage of maintain a high fastening force, but it has a disadvantage in that a certain assembly time is needed to turn the cap many times with respect to the container so that assemblability may be lowered, in particular, it is difficult for the elderly or sick and the like with insufficient hand grip strength to open the cap easily.

In a push & pull type one-touch method, which uses a structure that opens/closes the inlet of the container using the elastic deformation of the cap, opening/closing is made normally by pressing or pulling the cap with one hand while holding the container with the other hand.

Although such a one-touch method has an advantage of achieving the opening/closing of the cap within a short time, there is a limit in sealing ability so that there is always a risk that the contents of the container could leak.

The present applicant has developed the opening/closing structure of the above-described one-touch method, by not only enabling the opening/closing of a cap within a short time, but improving a fastening force between the cap and the container, and obtained Korean Patent No. 10-0757795, Korean Patent No. 10-1121860, and the like.

However, according to the related art, since the structure for one-touch opening/closing of a cap and a container is relatively complicated, there remains a concern that each constituent element may not perform a desired function smoothly due to manufacturing tolerances during mass production by injection.

DETAILED DESCRIPTION OF THE INVENTIVE CONCEPT

Technical Problem

The present inventive concept provides a structure for one-touch opening/closing of a cap and a container, whereby productivity and assemblability of a product may be greatly improved because sealing is made by only an operation of pressing a cap that is integrally injection-molded through a simpler structure, user's convenience of use may be improved because the cap can be easily opened with one hand only, and product quality and market competitiveness may be maximized because whether the cap is opened for the first time can be easily checked.

Solution to Problem

According to an aspect of the present inventive concept, a structure for one-touch opening/closing of a cap and a container includes the container including an inlet and an engaging ledge formed on an outer circumferential surface thereof, and the cap including a sealing portion and a cover portion, the sealing portion including a hook member formed thereon corresponding to the engaging ledge, and opening the inlet of the container while ascending and closing the inlet of the container while descending as the hook member is put on the engaging ledge, the cove portion being formed as a barrel-shaped body for accommodating the sealing portion therein, wherein the cap may further include a connection portion that is integrally molded by connecting the sealing portion and the cover portion, the connection portion including a thin deformable member capable of folding deformation and a thick turning member that is thicker than the thin deformable member, the thick turning member is connected to an upper end of the cover portion and elastically deforms the cover portion outwardly during opening of the cap, and a recessed groove for inducing deformation is formed in the thin deformable member to allow the connection portion to be folded and caught inside the cover portion in a radial direction.

Here, the cover portion may include a small diametric portion having an inner circumferential surface to restrict a maximum displacement with respect to deformation of the hook member outwardly in a radial direction, and a large diametric portion having an inner circumferential surface greater than the small diametric portion.

The cover portion may include a support member in which a groove and a rail are formed to restrict the maximum displacement with respect to the deformation of the hook member outwardly in the radial direction to differ according to a vertical location relative to the sealing portion.

Furthermore, the hook member of the sealing portion may include a pair of wing hooks formed apart from each other in a form of a cantilever, a cross-link connecting the pair of wing hooks, and a center hook located in a middle of the cross-link, the support member of the cover portion may include a pair of locking rails corresponding to the pair of wing hooks and a support rail located in a middle of the pair of locking rails to correspond to the center hook, a locking groove for accommodating an end edge of the wing hook may be formed in the locking rail, and a support groove for accommodating an end edge of the center hook may be formed in the support rail.

Also, a center protrusion capable of plastic deformation corresponding to the support groove may protrude from a lower end of the center hook.

Besides, a sealing lip and a sealing rail may be provided on a bottom surface of the sealing portion to be in contact with inside and outside of the inlet of the container, respectively, and a wing handle for gripping with a finger may protrude from a lower outer circumference of the cover portion.

In addition, an upper step having a step-like cross-section may be formed at an upper edge of the sealing portion along an entire circumference thereof, a sealing hook may be formed on the cover portion corresponding to the upper step, a support ring may protrude from under the engaging ledge of the container along an entire outer circumferential surface thereof, and a stopper corresponding to the support ring may protrude from an inner circumferential surface of the cover portion.

Advantageous Effects

According to the present inventive concept, productivity and assemblability of a product may be greatly improved because sealing is made by only an operation of pressing a cap that is integrally injection-molded through a simpler structure, user's convenience of use may be improved because the cap can be easily opened with one hand only, and product quality and market competitiveness may be maximized because whether the cap is opened for the first time can be easily checked.

[List of reference numerals]

| | |
|---|---|
| 100: container | 110: inlet |
| 120: engaging ledge | 130: support ring |
| 200: cap | 210: sealing portion |
| 211: hook member | 211a: wing hook |
| 211b: cross-link | 211c: center hook |
| 211c-1: center protrusion | 212: sealing lip |
| 213: sealing rail | 214: upper step |
| 220: cover portion | 221: support member |
| 221a: locking rail | 221a-1: locking groove |
| 221b: support rail | 221b-1: support groove |
| 222: wing handle | 223: sealing hook |
| 224: stopper | 225: lower step |
| 230: connection portion | 231: thin deformable member |
| 231a: recessed groove | 232: thick turning member |
| 233: cutter | 234: trace |

MODE OF THE INVENTIVE CONCEPT

Figure 1:
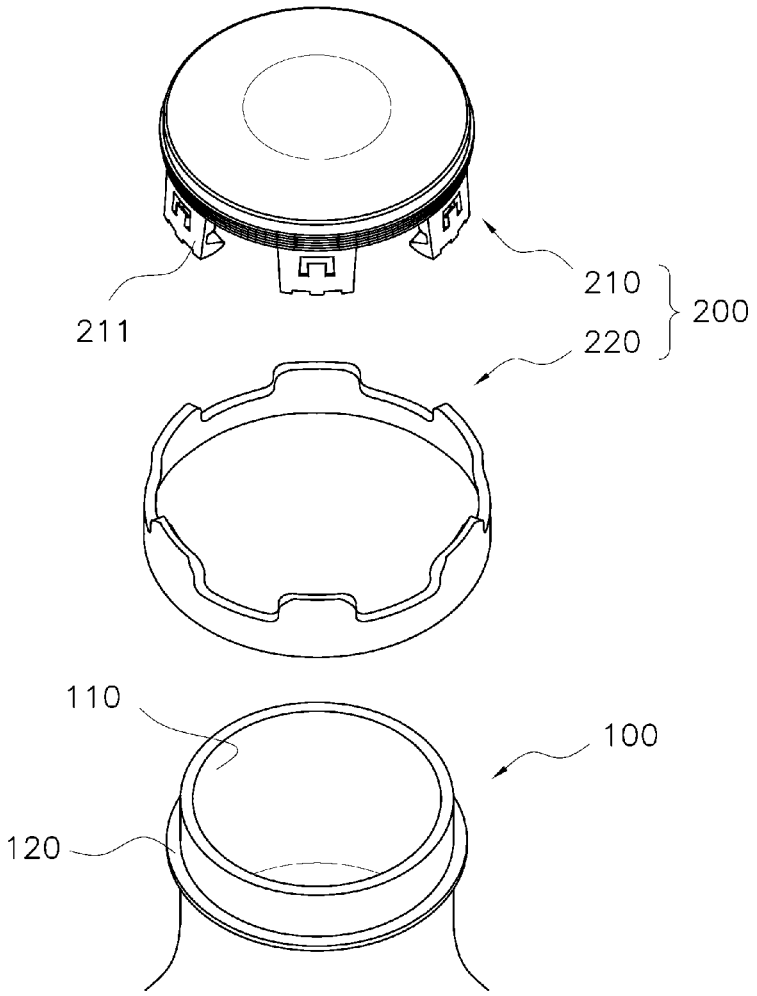
FIG. 1 is an exploded perspective view of a structure for one-touch opening/closing of a cap and a container according to the present inventive concept.
Figure 2:
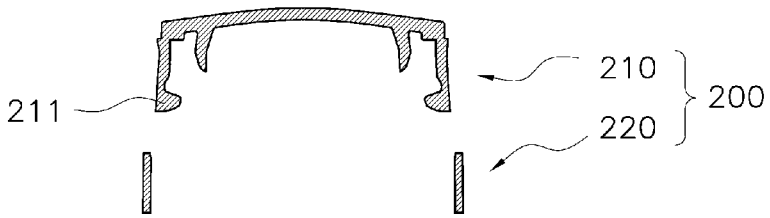
FIG. 2 is a cross-sectional view showing a cap in the structure for one-touch opening/closing of a cap and a container according to the present inventive concept.
Figure 3:
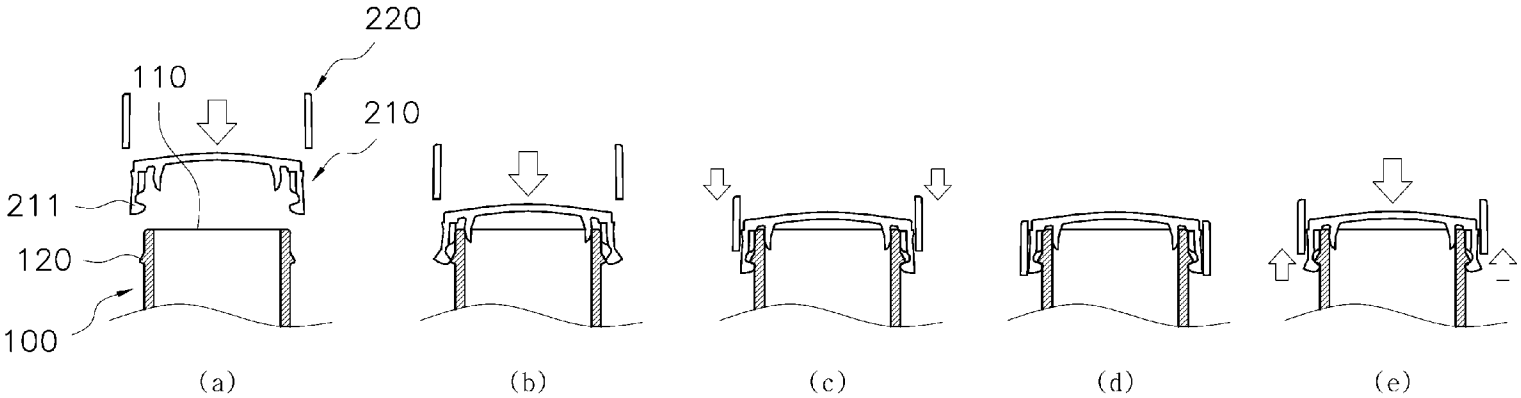
FIG. 3 is a cross-sectional view showing an operation state of a cap in the structure for one-touch opening/closing of a cap and a container according to the present inventive concept.

FIG. 1 is an exploded perspective view of a structure for one-touch opening/closing of a cap and a container according to the present inventive concept, FIG. 2 is a cross-sectional view showing a cap in the structure for one-touch opening/closing of a cap and a container according to the present inventive concept, and FIG. 3 is a cross-sectional view showing an operating state of a cap in the structure for one-touch opening/closing of a cap and a container according to the present inventive concept.

Figure 4:
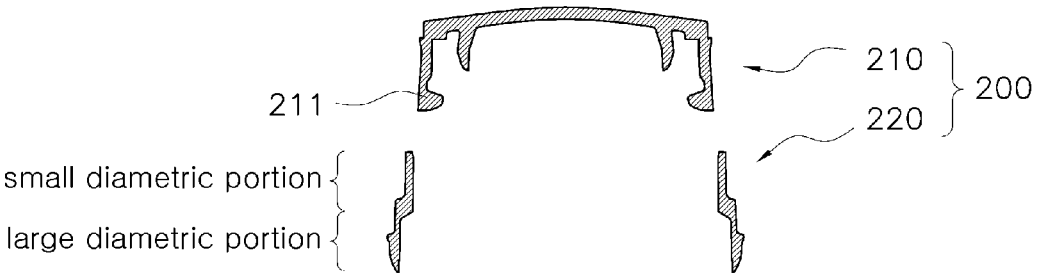
FIG. 4 is a cross-sectional view showing a modified example of a cover portion in the structure for one-touch opening/closing of a cap and a container according to the present inventive concept.

FIG. 4 is a cross-sectional view showing a modified example of a cover portion in the structure for one-touch opening/closing of a cap and a container according to the present inventive concept.

Figure 5:
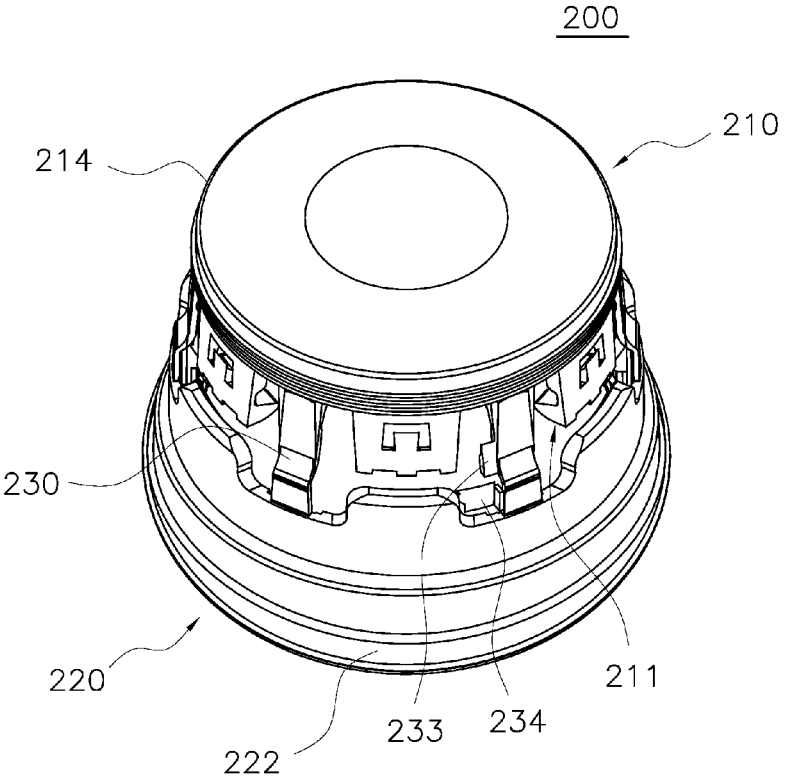
FIG. 5 is a perspective view showing a modified example of a cap in the structure for one-touch opening/closing of a cap and a container according to the present inventive concept.
Figure 6:
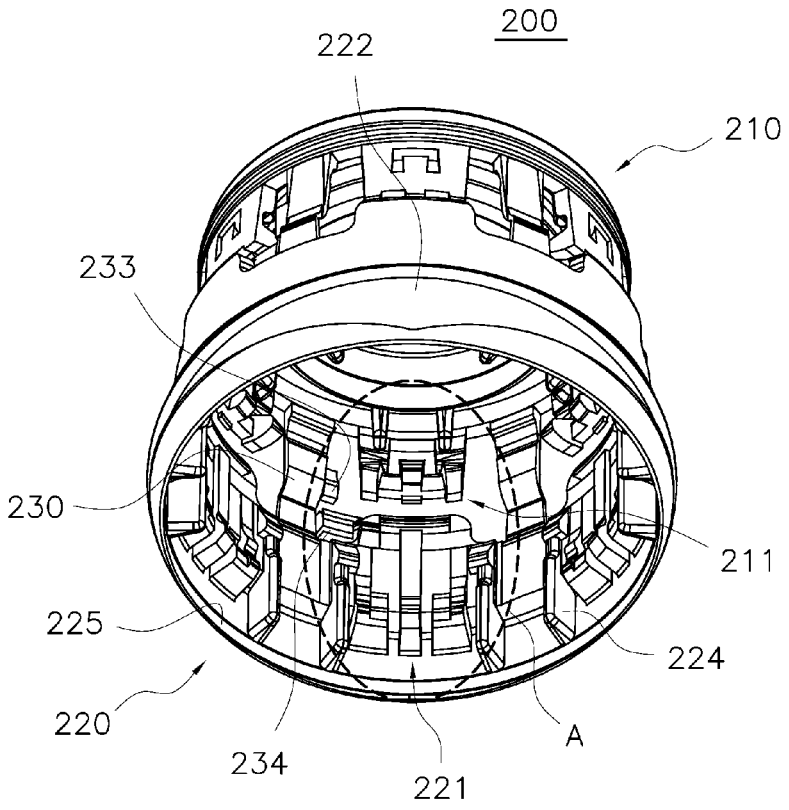
FIG. 6 is a bottom perspective view showing a modified example of the cap in the structure for one-touch opening/closing of a cap and a container according to the present inventive concept.
Figure 7:
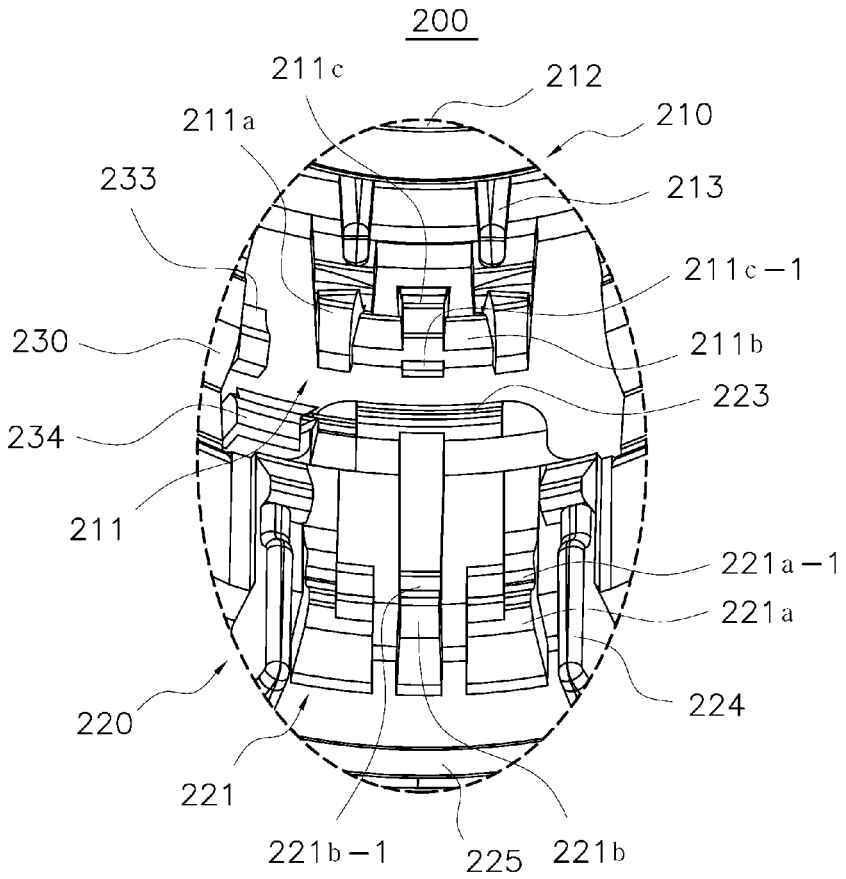
FIG. 7 is an enlarged view of a region A of FIG. 6.

Furthermore, FIG. 5 is a perspective view showing a modified example of a cap in the structure for one-touch opening/closing of a cap and a container according to the present inventive concept, FIG. 6 is a bottom perspective view showing a modified example of the cap in the structure for one-touch opening/closing of a cap and a container according to the present inventive concept, and FIG. 7 is an enlarged view of a region A of FIG. 6.

Figure 8:
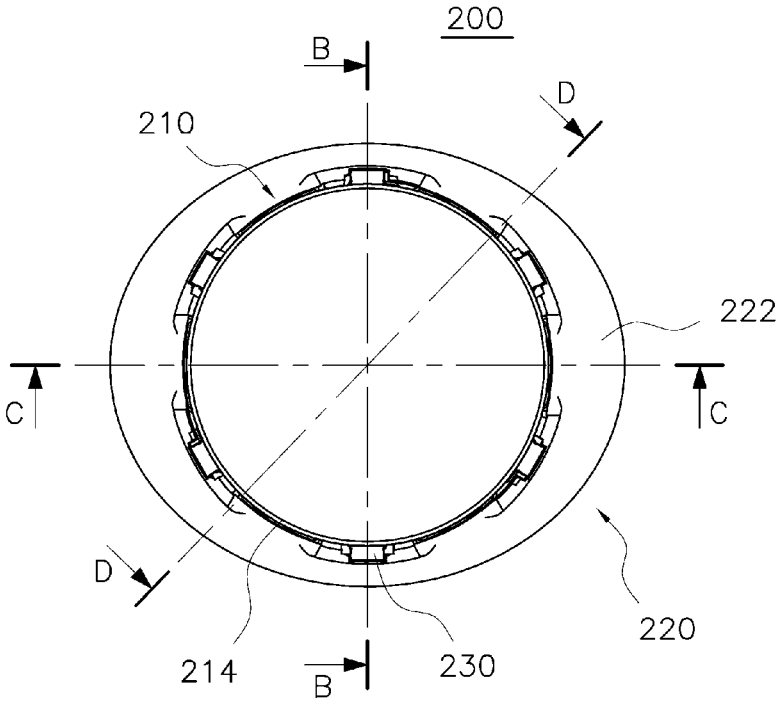
FIG. 8 is a plan view showing a modified example of a cap in the structure for one-touch opening/closing of a cap and a container according to the present inventive concept.
Figure 9:
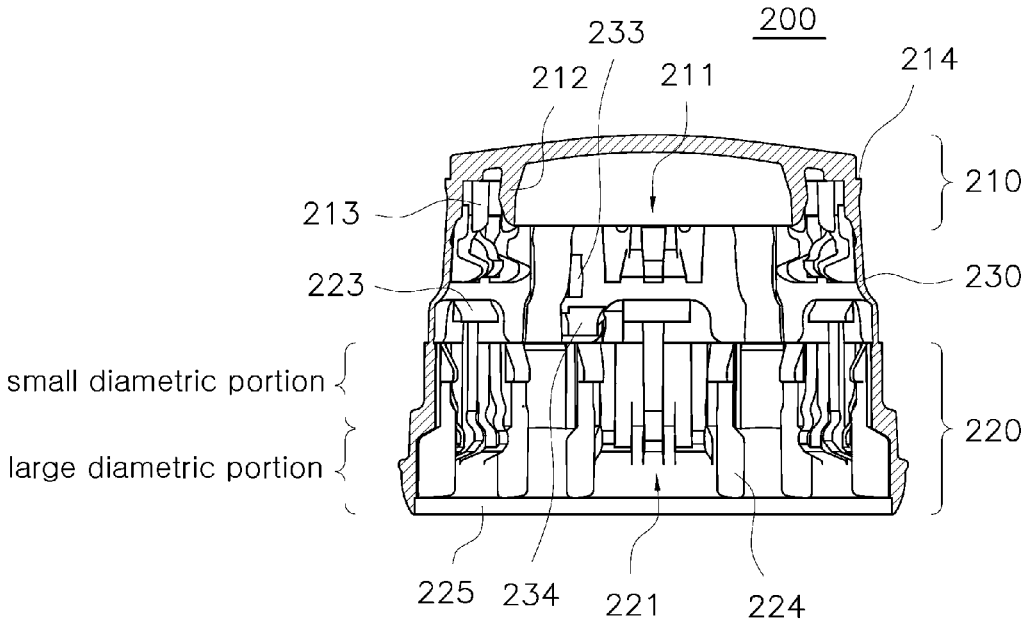
FIG. 9 is a cross-sectional view taken along line B-B of FIG. 8.
Figure 10:
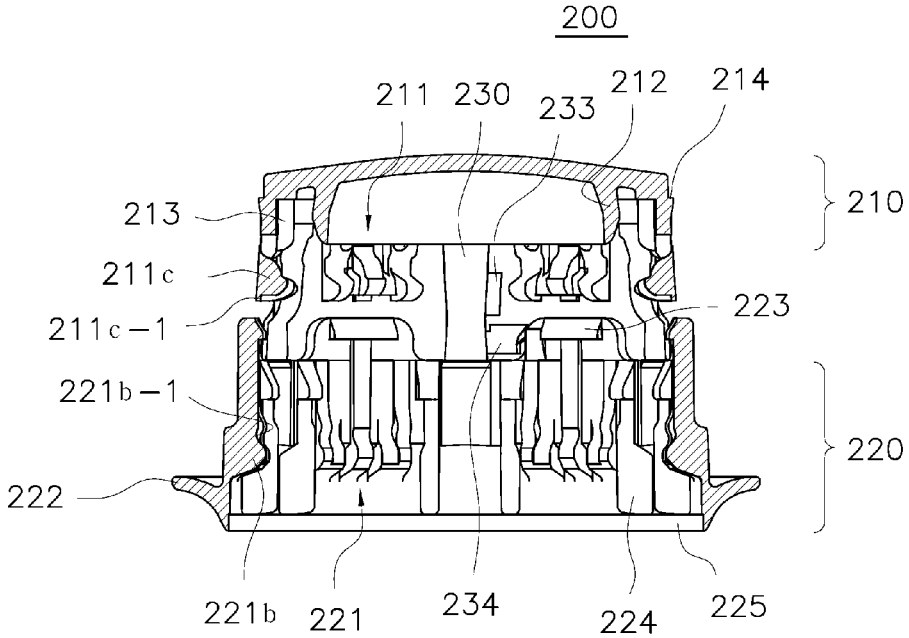
FIG. 10 is a cross-sectional view taken along line C-C of FIG. 8.
Figure 11:
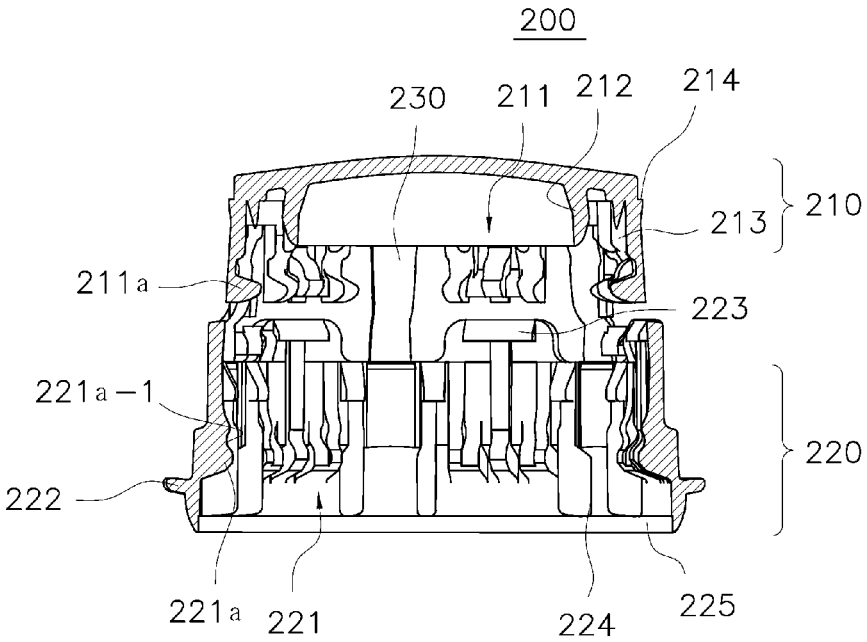
FIG. 11 is a cross-sectional view taken along line D-D of FIG. 8.

In addition, FIG. 8 is a plan view showing a modified example of a cap in the structure for one-touch opening/closing of a cap and a container according to the present inventive concept, FIG. 9 is a cross-sectional view taken along line B-B of FIG. 8, FIG. 10 is a cross-sectional view taken along line C-C of FIG. 8, and FIG. 11 is a cross-sectional view taken along line D-D of FIG. 8.

Figure 12:
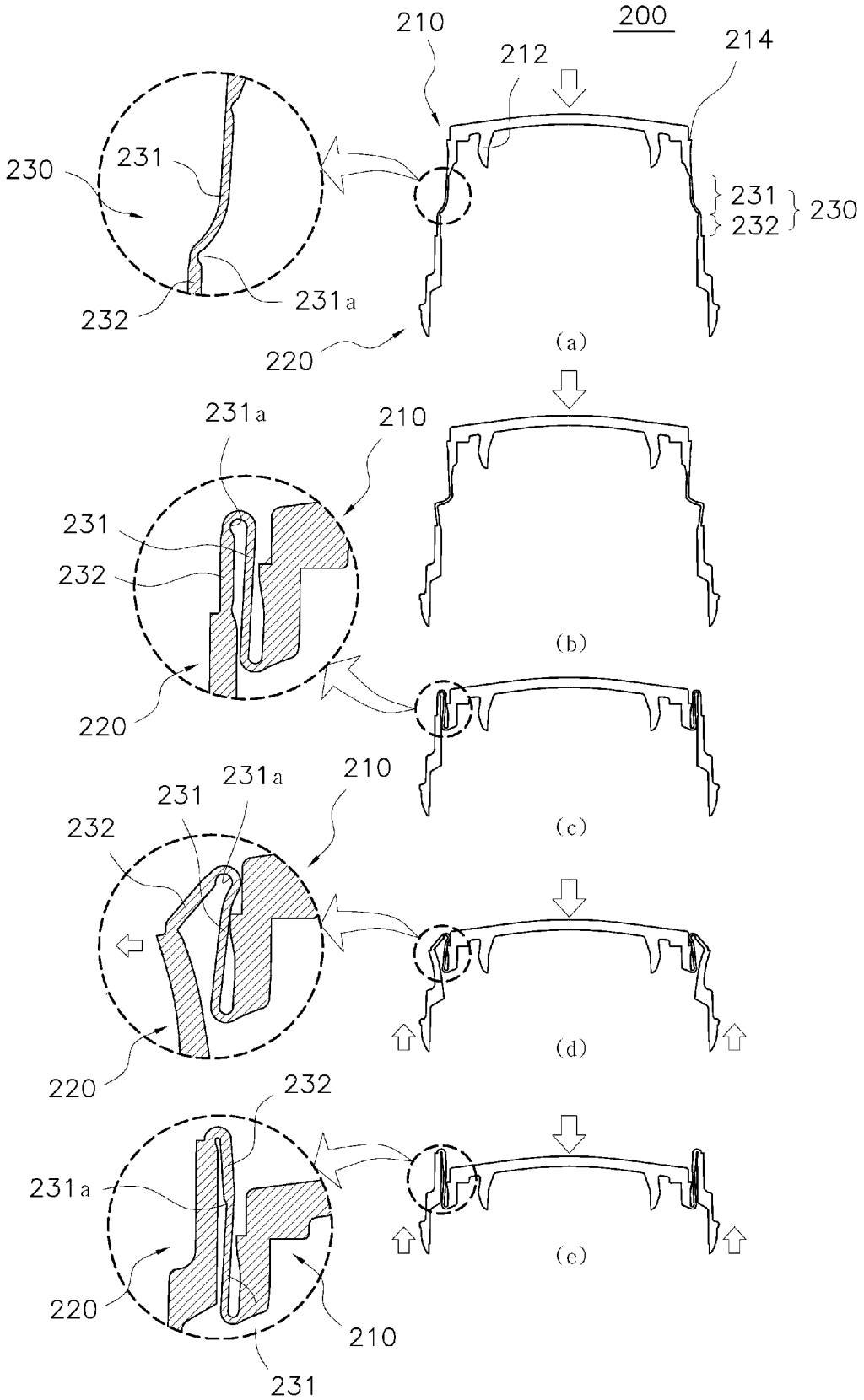
FIG. 12 is a cross-sectional view showing an operating state of a connection portion in the structure for one-touch opening/closing of a cap and a container according to the present inventive concept.
Figure 13:
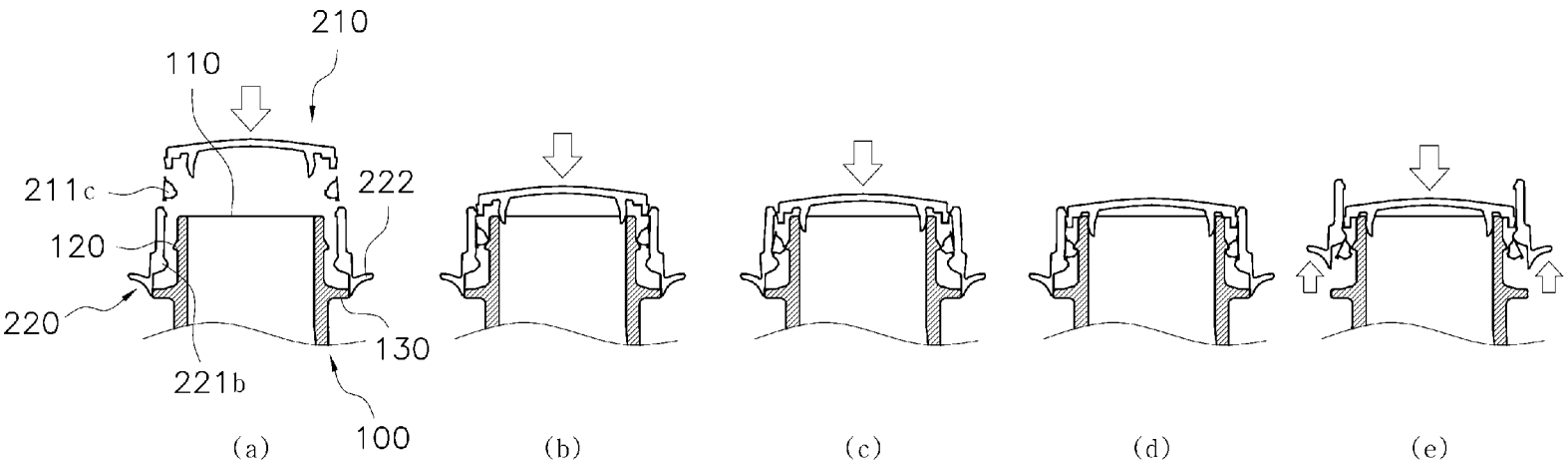
FIG. 13 is a cross-sectional view showing an operating state of a center hook in the structure for one-touch opening/closing of a cap and a container according to the present inventive concept.
Figure 14:
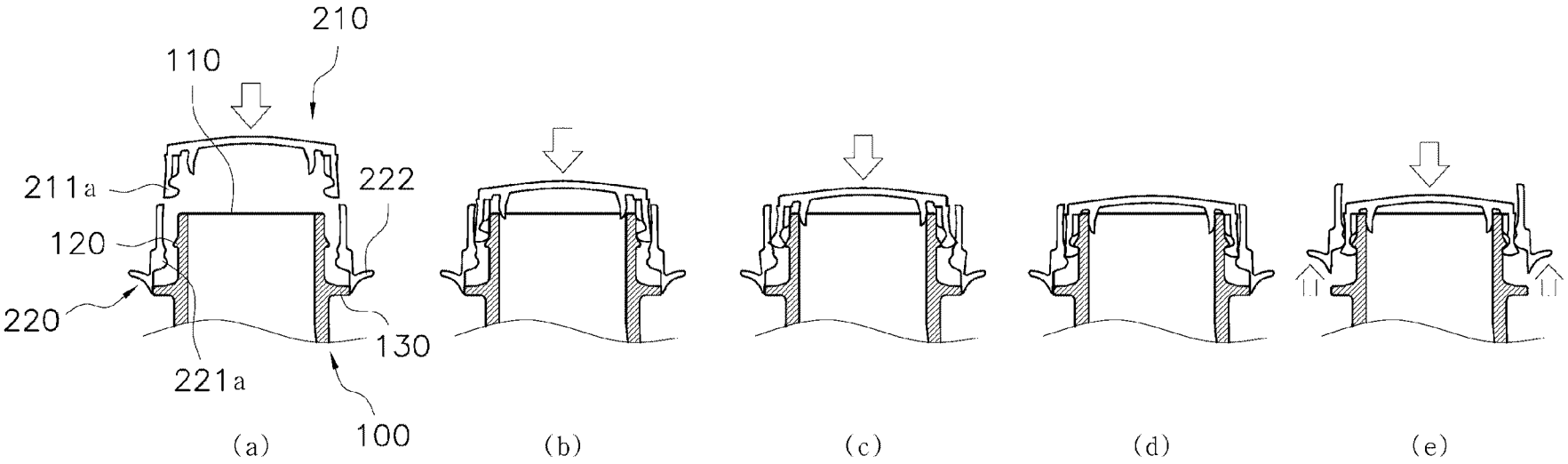
FIG. 14 is a cross-sectional view showing an operating state of a wing hook in the structure for one-touch opening/closing of a cap and a container according to the present inventive concept.

Last, FIG. 12 is a cross-sectional view showing an operating state of a connection portion in the structure for one-touch opening/closing of a cap and a container according to the present inventive concept, FIG. 13 is a cross-sectional view showing an operating state of a center hook in the structure for one-touch opening/closing of a cap and a container according to the present inventive concept, and FIG. 14 is a cross-sectional view showing an operating state of a wing hook in the structure for one-touch opening/closing of a cap and a container according to the present inventive concept.

The structure for one-touch opening/closing of a cap and a container according to the present inventive concept has the fundamental technical features in that productivity and assemblability of a product may be greatly improved because sealing is made by only an operation of pressing a cap that is integrally injection-molded through a simpler structure, user's convenience of use may be improved because the cap can be easily opened with one hand only, and product quality and market competitiveness may be maximized because whether the cap is opened for the first time can be easily checked.

An embodiment of the present inventive concept is described below in detail with reference to the accompanying drawings.

First, a structure for one-touch opening/closing of a cap and a container according to the present inventive concept, as illustrated in FIGS. 1 to 3, may include: a container 100 including an inlet 110 and an engaging ledge 120 formed on an outer circumferential surface thereof; and a cap 200 including a sealing portion 210 on which a hook member 211 is formed to correspond to the engaging ledge 120, the sealing portion 210 opening the inlet 110 of the container 100 while ascending, and closing the inlet 110 of the container 100 while descending, as the hook member 211 is put on the engaging ledge 120, and a cover portion 220 formed in a barrel-shaped body to accommodate the sealing portion 210 therein.

In other words, the structure for one-touch opening/closing of a cap and a container according to the present inventive concept basically includes the container 100 and the cap 200.

First, the container 100 is used to store, transport, or distribute beverages or various liquids.

To this end, the container 100 may be basically manufactured of synthesis resin capable of elastic deformation according to a change in the internal pressure of the content, or may be manufactured of various materials including glass as necessary.

However, in the present inventive concept, considering moldability and the like, injection molding of a synthesis resin material is most preferable.

The inlet 110 for injection and discharge of a liquid content is typically formed in the container 100, and the inlet 110 is described below based on a circular shape, but may be manufactured in a polygonal shape such as a regular rectangle shape or a regular hexagonal shape, as necessary, and there may be no limited in the shape thereof.

The engaging ledge 120 is formed, as shown in FIG. 1, around the inlet 110 of the container 100, in detail, on an outer circumferential surface apart a certain distance downward from the inlet 110.

The cross-sectional shape of the engaging ledge 120 includes two inclined planes, as shown in FIG. 3, in which a gentle inclined plane is formed close to the inlet 110 and an approximately perpendicular plane or an inclined plane having a sharp inclination close to the perpendicular plane.

As such, making the inclined planes of the engaging ledge 120 have different angles are to make the sealing of the container 100 by the cap 200 smooth and to make the opening of the cap 200 require a relatively large operating force.

The engaging ledge 120 may be formed along the entire outer circumferential surface of the container 100, or formed to be separated into two or more sections, as necessary.

Next, the cap 200 for opening/closing the inlet 110 of the container 100 may be functionally divided into the sealing portion 210 and the cover portion 220, and the sealing portion 210 and the cover portion 220 may also be manufactured of a synthesis resin material by injection molding.

First, during the manufacturing of the cap 200, the sealing portion 210 and the cover portion 220 may be independently and separately formed as shown in FIGS. 1 to 3, or the sealing portion 210 and the cover portion 220 may be integrally molded. An example of integrally molding the sealing portion 210 and the cover portion 220 will be described later, and an example in which the sealing portion 210 and the cover portion 220 are separately formed is first described.

The inlet 110 of the container 100 described above maintains relatively high stiffness so that deformation is hardly generated, whereas the cap 200 is basically elastically deformable, and is formed of a material capable of plastic deformation by a heavy load, as necessary.

As such, for the cap 200 to have desired appropriate physical properties, the cap 200 may be manufactured by mixing two or more materials selected from among thermoplastic resins at an appropriate ratio.

First, in the cap 200, the sealing portion 210 is located approximately in an upper side on the drawing by including an about horizontal surface, and a bottom surface thereof is configured to substantially open/close the inlet 110 of the container 100.

In other words, when the sealing portion 210 ascends with respect to the container 100, the bottom surface of the sealing portion 210 is separated from the inlet 110 of the container 100, thereby opening the inlet 110.

Reversely, when the sealing portion 210 descends with respect to the container 100, the bottom surface of the sealing portion 210 comes in contact with the inlet 110 of the container 100, thereby closing the inlet 110.

In this state, the hook member 211 having a hook shape and extending downward on the drawing and protruding inward in a radial direction is formed on an outer circumference of a lower end of the sealing portion 210, and according to the vertical location of the sealing portion 210, the hook member 211 may be optionally put on the engaging ledge 120 of the container 100 described above.

To this end, in the container 100, the hook member 211 of the sealing portion 210 may be molded to a length corresponding to a distance from the inlet 110 to the engaging ledge 120.

Although the drawing shows an example in which a total of six hook members 211 are formed on the sealing portion 210 at a phase angular difference of 60°, as necessary, less than or exceeding six hook members 211 may be formed.

The hook member 211 may be formed as one hook, or preferably as a plurality of hooks located apart from each other in the same shape.

As such, the hook member 211 including a plurality of hooks induces appropriate deformation in a desired shape with respect to the cover portion 220 that is described later, so that the hook member 211 does not easily escape from the engaging ledge 120 and a high sealing force is maintained.

Next, in the cap 200, the cover portion 220 is formed as a barrel-shaped body having a hollow pipe shape to accommodate the sealing portion 210 therein.

In other words, in the cap 200, according to the relatively vertical locations between the sealing portion 210 and the cover portion 220, the cap 200 may maintain a sealing state of the container 100, or the cap 200 may be changed to a state of being opened from the container 100.

Accordingly, as the cap 200 is assembled to the container 100, a portion of the sealing portion 210 other then an upper end thereof is located inside the inner circumferential surface of the cover portion 220.

To this end, in the cap 200, the diameter of the outer circumferential surface of the sealing portion 210 may be slightly greater than the diameter of the inner circumferential surface of the cover portion 220.

Accordingly, when the cover portion 220 is located outside the hook member 211, only a fine gap may be present between the outer circumferential surface of the sealing portion 210 and the inner circumferential surface of the cover portion 220.

Accordingly, the cover portion 220 may restrict the hook member 211 from being deformed outwardly in the radial direction.

Reversely, when the cover portion 220 is not located outside the hook member 211, the hook member 211 may be allowed to deform outwardly in the radial direction.

According to the configuration of the sealing portion 210 and the cover portion 220, as shown in (a) and (b) of FIG. 3, when the inlet 110 of the container 100 is sealed by the cap 200, the hook member 211 of the sealing portion 210 is put on the engaging ledge 120 of the container 100 and then fixed thereon.

Thereafter, as shown in (c) of FIG. 3, the sealing portion 210 is lowered and located outside the hook member 211, and thus, as shown in (d) of FIG. 3, the sealing state may be surely maintained.

In this state, a groove for accommodating an end edge of the hook member 211, that is, into which a portion of the hook member 211 enters to be put therein, may be additionally formed in the inner circumferential surface of the cover portion 220.

Accordingly, it is possible that the cover portion 220 more surely restricts the hook member 211 from escaping from the engaging ledge 120.

During the opening of the cap 200, as shown in (e) of FIG. 3, while a top surface of the cap 200 is pressed downward with a thumb, a lower end of the cover portion 220 is moved upward using index and middle fingers.

As a result, the cover portion 220 is separated from the sealing portion 210, and thus, the hook member 211 of the sealing portion 210 may escape from the engaging ledge 120 of the container 100 so that the cap 200 may be opened.

As described above, it is possible to easily open/close the inlet 110 of the container 100 with the cap 200.

Addition of functions by adding various configurations to the above-described basic structure for one-touch opening/closing of a cap and a container is described below.

First, as shown in FIG. 4, according to a modified example of the cap 200 in the structure for one-touch opening/closing of a cap and a container according to the present inventive concept, the cover portion 220 may include an small diametric portion having an inner circumferential surface to restrict the maximum displacement with respect to the deformation of the hook member 211 outwardly in the radial direction, and a large diametric portion having an inner circumferential surface greater than the small diametric portion.

In this state, a step-type seam may be formed between the small diametric portion and the large diametric portion, and the vertical location where the step-type seam is formed may be appropriately changed according to the length of the hook member 211 described above.

In other words, when the hook member 211 is located inside the small diametric portion of the cover portion 220, the hook member 211 may be restricted from being deformed outwardly in the radial direction, and when the hook member 211 is located inside the large diametric portion of the cover portion 220, the hook member 211 may be allowed to deform outwardly in the radial direction.

As described above, as the small diametric portion and the large diametric portion are formed on the cover portion 220, the total height of the cover portion 220 is extendable, and accordingly, various configurations may be additionally provided to the lower portion of the cover portion 220, that is, the inside of the large diametric portion.

For example, by forming a stopper within the large diametric portion formed on the cover portion 220, it may be possible that the stopper is located by being put on a support ring that is formed below the engaging ledge 120 during the molding of the container 100.

Next, the cap 200 in which the sealing portion 210 and the cover portion 220 are integrally formed is described.

In other words, in the structure for one-touch opening/closing of a cap and a container according to the present inventive concept, the cap 200 according to another modified example, as shown in FIGS. 5 to 7, is integrally molded by connecting the sealing portion 210 and the cover portion 220, and may further include a connection portion 230 including a thin deformable member 231 capable of folding deformation and a thick turning member 232 that is thicker than the thin deformable member 231.

According to the above configuration, as shown in (a) to (c) of FIGS. 13 and 14, after manufacturing of the cap 200 and before sealing of the container 100, the sealing portion 210 is located above the cover portion 220.

When the cap 200 seals the container 100, as shown in (d) of FIGS. 13 and 14, the sealing portion 210 is located inside the cover portion 220, and during the opening of the cap 200, as shown in (e) of FIGS. 13 and 14, the cover portion 220 may ascend with respect to the sealing portion 210.

In the cap 200, the connection portion 230, as shown in FIGS. 9 and 12, may be a strap-shaped body having a relatively thin thickness so that an upper end thereof is connected to the sealing portion 210 and a lower end is connected to the cover portion 220.

As such, the connection portion 230 that is molded may be located by being folded in a fine gap formed between the sealing portion 210 and the cover portion 220, as the sealing portion 210 is located within the cover portion 220, as shown in (c) to (e) of FIG. 12, as described above.

Accordingly, the connection portion 230 may maintain a state of being folded in an about "S" shape within the fine gap between the sealing portion 210 and the cover portion 220, and may be smoothly deformed while maintaining the about "S" shape according to a relative height change of the sealing portion 210 and the cover portion 220.

In particular, in the present inventive concept, the connection portion 230 does not merely connect the sealing portion 210 and the cover portion 220 described above, but may have a function of appropriately restricting the cover portion 220 from ascending with respect to the sealing portion 210 during the opening of the cap 200.

To this end, in the present inventive concept, the connection portion 230 is not formed to have a relatively thin constant thickness over the total length, but may be manufactured by being divided into two configurations according to a thickness difference, as shown in FIGS. 9 and 12.

In other words, the connection portion 230 may include the thin deformable member 231 that is smoothly folding deformable, and the thick turning member 232 that is thicker than the thin deformable member 231 so that a relatively large operating force is needed during folding deformation.

First, the thin deformable member 231 has a relatively thin thickness so as to be smoothly deformable by connecting the sealing portion 210 and the cover portion 220.

In contrast, the thick turning member 232 is formed to be relatively thicker than the thickness of the thin deformable member 231, so that a large operating force is needed for folding deformation.

In this state, the thick turning member 232 of the connection portion 230 needs to be molded at an appropriate position, and FIG. 12 illustrates an example in which the thick turning member 232 is formed to be connected to the upper end of the cover portion 220.

According to such a configuration, in the connection portion 230 which connects the sealing portion 210 and the cover portion 220, during the sealing of the cap 200 as shown in (c) of FIG. 12, the thin deformable member 231 is located in a folded state forming a cross-section of about "S" shape in a space between the sealing portion 210 and the cover portion 220.

As a result, according to the relative vertical locations of the sealing portion 210 and the cover portion 220, the thin deformable member 231 may be smoothly deformed.

However, during the opening of the cap 200, in the connection portion 230, the thick switching member 232 needs a large operating force during folding deformation, and thus, as shown in (d) of FIG. 12, when the cover portion 220 of the cap 200 is ascended, and the thick switching member 232 is folding-deformed, the thick switching member 232 is elastically deformed by pushing the inner circumferential surface of the cover portion 220 outwardly.

In the above operation, in detail, when the cap 200 seals the container 100, and the cover portion 220 is gradually ascended with respect to the sealing portion 210 to open the cap 200, the thin deformable member 231 is smoothly deformed before a state shown in (d) of FIG. 12.

However, when such deformation occurs in the thick turning member 232, a large operating force is needed for the deformation of the thick turning member 232.

When a large operating force is applied under this state, the inner circumferential surface of the cover portion 220 is elastically deformed outwardly due to the deformation of the thick turning member 232, and thus, the thick turning member 232 may be deformed only under a large operating force.

In other words, only when a large operating force needed for the deformation of the thick turning member 232 is applied, as shown in (e) of FIG. 12, the thick turning member 232 is folded inwards and folding-deformed so that the cover portion 220 is allowed to ascend.

As a result, a space for the hook member 211 located inside in the radial direction can escape from the engaging ledge 120 of the container 100 may be secured by the large diametric portion.

Accordingly, when no large operating force needed for the thick turning member 232 is applied from the outside, the opening of the cap 200 may not be made.

In other words, in the conventional structure for one-touch opening/closing of a cap and a container by the present applicant, to maintain the sealing state of the cap 200, a separate protrusion to control the hook member 211 described above is necessarily needed.

However, according to the present inventive concept, it is the biggest feature that the cap 200 can maintain the sealing state, without the protrusion for controlling the hook member 211, by only changing the thickness of the connection portion 230 at an appropriate position.

In addition, when the sealing portion 210 descends to enter the inside of the cover portion 220, in the connection portion 230, it is possible to induce the deformation direction of the connection portion 230 so that the thin deformable member 231 is located by being folded between the sealing portion 210 and the cover portion 220.

To this end, as shown in (a) of FIG. 12, an recessed groove 231*a* that has a very thin thickness to induce deformation is formed in the middle of the thin deformable member 231, and thus, it is possible to allow the connection portion 230 to be folded and caught inside the cover portion 220 in the radial direction, during the descending of the sealing portion 210, as shown in (b) of FIG. 12.

In addition, when the content in the container 100 is carbonated or fermented beverages, the pressure generated in the container 100 is relatively high, and thus, a configuration for controlling the hook member 211 may be added, as necessary.

In other words, in the present inventive concept, the cover portion 220 may include a support member 221 in which a groove and a rail are formed to restrict the maximum displacement of the hook member 211 outwardly in the radial direction to differ according to a vertical location relative to the sealing portion 210.

The support member 221, as shown in FIG. 6, is formed on the inner circumferential surface of the cover portion 220 in a vertical direction, and the rail may include a gentle inclined plane and may be formed to an appropriate height in the radial direction according to the vertical directional location of the cover portion 220.

Furthermore, as the groove is formed at an appropriate position on the rail of the support member 221, when the hook member 211 is put on the engaging ledge 120, the hook member 211 may be restricted at the appropriate position from being deformed outwardly in the radial direction.

Such a combination of the rail and the groove enables the support member 221 to more effectively control the hook member 211.

In particular, in the present inventive concept, by further improving the hook member 211 of the sealing portion 210 described above and the support member 221 of the cover portion 220 described above, it is possible to perform accurate opening/closing of the cap 200 with respect to the container 100.

To this end, in the present inventive concept, as shown in FIGS. 7, 10, and 11, the hook member 211 of the sealing portion 210 includes a pair of wing hooks 211*a* formed apart from each other in the form of a cantilever, a cross-link 211*b* connecting the pair of wing hooks 211*a*, and a center hook 211*c* located in the middle of the cross-link 211*b*, the support member 221 of the cover portion 220 includes a pair of locking rails 221*a* corresponding to the wing hooks 211*a*, and a support rail 221*b* located in the middle of the pair of locking rails 221*a* to correspond to the center hook 211*c*, in which a locking groove 221*a*-1 for accommodating an end edge of each of the wing hooks 211*a* is formed on the locking rails 221*a*, and a support groove 221*b*-1 for accommodating an end edge of the center hook 211*c* is formed in the support rail 221*b*.

In other words, in the present inventive concept, the hook member 211 may include three hooks of the wing hooks 211*a* formed at both sides of one center hook 211*c*, and the support member 221 may include three rails of the locking rails 221*a* formed at both sides of one support rail 221*b*.

The hook member 211 and the support member 221 may each be provided in plural by paring each other with respect to one cap 200, and on the drawing, illustrated is an example in which six hook members 211 and six support members 221 are formed in pairs.

In this state, the center hook 211*c* and the wing hooks 211*a* of the hook member 211 all are hooks molded in a hook shape to direct the inside in the radial direction, and in the form of a cantilever extending downwardly from the outer circumference of the sealing portion 210, which enables the radial deformation of the hook member 211.

The center hook 211*c* is supported by the cross-link 211*b* that connects the two wing hooks 211*a* located at both sides, thereby facilitating rotation.

Accordingly, the inside of the center hook 211*c* and the wing hooks 211*a* in the radial direction may be optionally put on the engaging ledge 120 of the container 100.

The support rail 221*b* and the locking rails 221*a* are formed as the support member 221 in the vertical direction parallel to each other, outside the center hook 211*c* and the wing hooks 211*a* in the radial direction.

In this state, the locking rails 221*a* of the support member 221 correspond to the wing hooks 211*a* of the hook member 211 may restrict the deformation of the wing hooks 211*a* outwardly in the radial direction to an appropriate height, according to the shape of the locking rails 221*a*.

The support rail 221*b* of the support member 221 also corresponds to the center hook 211*c* of the hook member 211 may restrict the deformation of the center hook 211*c* outwardly in the radial direction to an appropriate height according to the shape of the support rail 221*b*.

In addition, the locking groove 221*a*-1 for accommodating the end edges of the wing hooks 211*a* is formed in the locking rails 221*a*, so that the end edges of the wing hooks 211*a* are guided to be located in the locking groove 221*a*-1.

In addition, the locking groove 221*a*-1 restricts the deformation of the wing hooks 211*a* outwardly in the radial direction when the wing hooks 211*a* is put on the engaging ledge 120 of the container 100, to prevent the opening of the cap 200 as the wing hooks 211*a* is released from the engaging ledge 120.

Furthermore, the support groove 221*b*-1 for accommodating the end edge of the center hook 211*c* is formed in the support rail 221*b*, so that the end edge of the center hook 211*c* is guided to be located in the support groove 221*b*-1.

The support groove 221*b*-1 restricts the deformation of the center hook 211*c* outwardly in the radial direction when the center hook 211*c* is put on the engaging ledge 120 of the container 100, to prevent the opening of the cap 200 as the center hook 211*c* is released from the engaging ledge 120.

In particular, in the present inventive concept, as the center hook 211*c* and the wing hooks 211*a* described above are formed to have different cross-sectional shapes, and the support rail 221*b* and the locking rails 221*a* described above are formed to have different cross-sectional shapes, thereby increasing the coupling force between the cap 200 and the container 100.

In other words, the maximum protrusion height of the center hook 211*c* in the radial direction is less than the maximum protrusion height of the wing hooks 211*a* in the radial direction.

However, a convex protrusion protrudes from an upper side of a hook portion of the center hook 211*c*, and a concave recess is formed in an upper side of a hook portion of each of the wing hooks 211*a*.

According to the above configuration, when the cap 200 is to be opened from the container 100, as shown in (d) of FIG. 13, the center hook 211*c* that is put on the engaging ledge 120 rotates with respect to the cross-link 211*b*, and thus, the inner circumferential surface of the cover portion 220 located outwardly in the radial direction is deformed outwardly.

Accordingly, when a portion of the cover portion 220 located outside the center hook 211*c* deforms outwardly, a portion of the cover portion 220 located outside the wing hooks 211*a* in the radial direction is induced corresponding thereto to be deformed inwardly as shown in (d) of FIG. 14.

As a result, when the cap 200 seals the inlet 110 of the container 100, when viewed from the top as shown in FIG. 8, the cover portion 220 that is circular is elastically deformed in the form of an approximately polygon, and thus, the coupling force between the wing hooks 211*a* and the engaging ledge 120 is increased.

To smoothly induce the deformation, as shown in FIG. 7, the radial thickness of the wing hooks 211*a* is formed thick such that an upper portion of the cross-link 211*b* connecting the center hook 211*c* and the wing hooks 211*a* maintains a relatively narrow width.

In addition, the radial thickness of the wing hooks 211*a* may be formed thin such that a lower portion thereof connecting the center hook 211*c* and the wing hooks 211*a* maintains a relatively broad width.

Accordingly, in the hook member 211 described above, as the center hook 211*c* is pushed outwardly in the radial direction, it is possible to induce deformation such that the wing hooks 211*a* are gathered toward the center hook 211*c*, so that a high coupling force may be maintained.

In addition, the shape of a hook tip portion of each of the wing hooks 211*a* is taper-processed to be gradually wider toward the center hook 211*c* so that the deformation of the wing hooks 211*a* described above may be smoothly induced in a desired form.

Furthermore, as the locking rails 221*a* that support the wing hooks 211*a* outside in the radial direction are eccentrically arranged to be located at both sides in the circumferential direction, it is possible to additionally induce the deformation of the wing hooks 211*a* to be gathered toward the center hook 211*c*.

According to the above configuration and operation, compared with the related art, it is possible that the cap 200 keeps high sealing coupling force with respect to the container 100.

In addition, in the present inventive concept, as shown in FIG. 7, a center protrusion 211*c*-1 capable of plastic deformation may protrude corresponding to the support groove 221*b*-1 from the lower end of the center hook 211*c*.

The center protrusion 211*c*-1 protrudes from the lower end of the center hook 211*c* to a relatively thin thickness, and as the center protrusion 211*c*-1 is formed, the center protrusion 211*c*-1 may substantially first contact the support groove 221*b*-1 to be plastic-deformed within the support groove 221*b*-1 of the support rail 221*b*.

As a result, when the center hook 211*c* enters the support groove 221*b*-1 of the support rail 221*b*, the center hook 211*c* for facilitating smooth entering and accommodation may appropriately adjust an operating force needed for the center hook 211*c* to escape from the support groove 221*b*-1.

For example, when the center protrusion 211*c*-1 is formed to be high and thin, plastic deformation is smoothly performed accordingly, and thus, the sealing and opening of the cap 200 may be smoothly performed.

However, reversely thereto, when the center protrusion 211*c*-1 is formed to be low and thick, a large operating force is needed for the plastic deformation of the center protrusion 211*c*-1, and thus, a large operating force may be needed for the sealing and opening of the cap 200.

In other words, it is possible to open/close the cap 200 with respect to the container 100 with a desired operating force through the center protrusion 211*c*-1.

In addition, in the present inventive concept, a sealing lip 212 and a sealing rail 213 are provided on the bottom surface of the sealing portion 210 to be in contact with the inside and the outside of the inlet 110 of the container 100, respectively, and a wing handle 222 for gripping with a finger may protrude from a lower outer circumference of the cover portion 220.

First, the sealing lip 212 may be formed on the bottom surface of the sealing portion 210 to be in contact with the inner circumferential surface of the inlet 110 of the container 100.

The sealing lip 212 is formed to have a relatively thin thickness and basically increases hermeticity between the inlet 110 of the container 100 and the sealing portion 210, and additionally elastically supports the sealing portion 210 upwardly from the inlet 110 of the container 100, thereby assisting the hook member 211 to be accurately put on the engaging ledge 120.

Furthermore, the sealing rail 213 may be formed on the bottom surface of the sealing portion 210 to be in contact with the outer circumferential surface of the inlet 110 of the container 100.

The sealing rail 213 extends a certain length in the vertical direction with an approximately semi-circular cross-section, thereby increasing the mutual tightness between the inlet 110 of the container 100 and the above-described the sealing lip 212.

In addition, the wing handle 222 to be gripped with a finger may protrude from the lower outer circumference of the cover portion 220.

The wing handle 222 may be provided in plural, but most preferably, two wing handles 222 may be formed on one cover portion 220 with a phase angle difference of 180°.

Accordingly, a user, as shown in (e) of FIGS. 13 and 14, while supporting downwardly the above-described the sealing portion 210 with a thumb, by moving two wing handles 222 upwardly with an index finger and a middle finger, the cap 200 is possibly opened.

Accordingly, according to the structure for one-touch opening/closing of a cap and a container according to the present inventive concept, it is possible to easily open the cap 200 that seals the container 100 with only one hand.

In addition, in the present inventive concept, an upper step 214 having a step-like cross-section is formed at an upper end edge of the sealing portion 210 along the entire circumference thereof, a sealing hook 223 is formed on the cover portion 220 corresponding to the upper step 214. A support ring 130 protrudes from under the engaging ledge 120 of the container 100 along the entire outer circumferential surface thereof, and a stopper 224 corresponding to the support ring 130 may protrude from the inner circumferential surface of the cover portion 220.

First, while the upper step 214 having a step-like cross-section formed at the upper end edge of the sealing portion 210 along the entire circumference thereof, the sealing hook 223 that is put on and fixed to the upper step 214 may be formed at multiple positions on the cover portion 220.

Although, on the drawing, a total of six sealing hooks 223 are formed with a phase angle difference of 60°, the present inventive concept is not limited thereto.

In this state, the sealing hook 223 is formed to a length such that the hook member 211 of the sealing portion 210 may maintain a state of being put on and fixed to the engaging ledge 120 of the container 100, and thus, when the cap 200 seals the inlet 110 of the container 100, the sealing hook 223 may be put on the upper step 214.

Furthermore, in the present inventive concept, the support ring 130 protrudes from under the engaging ledge 120 of the container 100 along the entire outer circumferential surface thereof, as shown in FIGS. 13 and 14, which may be necessarily formed during the injection molding of the container 100.

Accordingly, the stopper 224 corresponding to the support ring 130 protrudes from the inner circumferential surface of the cover portion 220.

The stopper 224 is formed on the inner circumferential surface of the cover portion 220 in the vertical direction, and when a lower end of the stopper 224 comes in contact with the support ring 130, the cover portion 220 is restricted from further descending.

In addition, aside from the stopper 224 described above, a lower step 225 having a step-like cross-section is additionally formed on a lower outer circumference of the cover portion 220, and as the lower step 225 surrounds and supports the support ring 130, the descending of the cover portion 220 may be surely restricted at a desired height.

Lastly, in the present inventive concept, a cutter 233 is formed in the middle of the connection portion 230, a trace 234 for checking opening or not is connected between the connection portion 230 and the cover portion 220, and during the ascending of the cover portion 220, the trace 234 may be cut by the cutter 233.

In other words, the cutter 233 and the trace 234 are a configuration for a user to visually check whether it is the first-time opening of the cap 200, and the cutter 233 is formed, during the manufacturing of the cap 200, to protrude in the middle of the connection portion 230 in the circumferential direction.

The trace 234 connects the connection portion 230 and the sealing hook 223, and one or more of both ends of the trace 234 are thinly connected so as to be easily cut off by an external force.

The trace 234 is formed to be located below the cutter 233 during the manufacturing of the cap 200, but as the sealing portion 210 is located inside the cover portion 220, the cutter 233 is reversed to be located below the trace 234. During the opening of the cap 200, the cutter 233 ascends together as the cover portion 220 ascends with respect to the sealing portion 210, and thus, the cutter 233 cuts any one of both ends of the trace 234 that are initially connected to each other.

Accordingly, the user visually checks whether the trace 234 is connected or not so that it may be easily checked whether the sealing of the cap 200 is removed.

The operation of the present inventive concept is described below with reference to the accompanying drawings.

The structure for one-touch opening/closing of a cap and a container according to the present inventive concept configured as above molds the cap 200 largely including the sealing portion 210, the cover portion 220, and the connection portion 230 as one body.

In this state, the cap 200 is placed on the inlet 110 of the container 100 to be sealed, as shown in (a) of FIGS. 13 and 14.

In this state, the lower step 225 having a step-like cross-section formed on the lower outer circumference of the cover portion 220 and a plurality of stoppers 224 formed on the inner circumferential surface of the cover portion 220 are supported on the support ring 130 molded during the injection of the container 100.

When an upper end of the sealing portion 210 is pressed, as shown in (b) of FIGS. 13 and 14, the sealing portion 210 descends and is inserted into the cover portion 220.

Accordingly, the connection portion 230 is folded, as shown in (b) of FIG. 12, and enters a gap between the outer circumferential surface of the sealing portion 210 and the inner circumferential surface of the cover portion 220, as shown in (c) of FIG. 12.

In this state, the cutter 233 of the connection portion 230 is located below the trace 234 without interference with the trace 234.

Thereafter, when the center hook 211*c* and the two wing hooks 211*a* of the hook member 211 come in contact with the engaging ledge 120 formed on the container 100, as shown in (c) of FIGS. 13 and 14, the center hook 211*c* and the wing hooks 211*a* move over the engaging ledge 120.

In this state, the cover portion 220 located outside the center hook 211*c* and the wing hooks 211*a* in the radial direction is temporarily elastically deformed outwardly and restored, and accordingly, the hook member 211 is put on the engaging ledge 120 so that the cap 200 is in a sealing state as shown in (d) of FIGS. 13 and 14.

In the hook member 211, while the center hook 211*c* is supported by the support rail 221*b*, the center protrusion 211*c*-1 is located in the support groove 221*b*-1 formed in the middle of the support rail 221*b*, and thus, the center protrusion 211*c*-1 is surely prevented from escaping from the engaging ledge 120.

In addition, in the hook member 211, while the wing hooks 211*a* is also supported by the locking rails 221*a*, a lower end edge of the wing hooks 211*a* is located in the locking groove 221*a*-1 formed in the middle of the locking rails 221*a*, and thus, the wing hooks 211*a* are prevented from escaping from the engaging ledge 120.

In this state, the sealing hook 223 additionally formed on the cover portion 220 is also put on the upper step 214 formed on the sealing portion 210 and thus obtains a higher fastening force.

Thereafter, when the cap 200 is to be opened from the inlet 110 of the container 100, as shown in (e) of FIGS. 13 and 14, while a user supports the sealing portion 210 described above downwardly with a thumb, the two wing handle 222 is moved upwardly with an index finger and a middle finger, and thus, the cap 200 starts to be opened.

In the above beginning of opening time, the hook member 211 does not escape from the engaging ledge 120, and only the cover portion 220 ascends with respect to the sealing portion 210.

In this state, as described above, in the connection portion 230, the thin deformable member 231 is smoothly folding-deformed, as shown in (d) of FIG. 12, but the thick turning member 232 needs a large operating force for folding deformation.

Accordingly, it may be effectively prevented that the cap 200 is self-opened, not by a user, in the storage or distribution stage.

Thereafter, when the thick turning member 232 is fold-deformed as shown in (e) of FIG. 12, the sealing portion 210 and the cover portion 220 that have been elastically deformed are restored so that the cover portion 220 ascends and the large diametric portion of the cover portion 220 is located outside the hook member 211 in the radial direction.

Accordingly, in the hook member 211, as the deformation of the center hook 211*c* and the wing hooks 211*a* outwardly in the radial direction is possible, the center hook 211*c* and the wing hooks 211*a* move over the engaging ledge 120 of the container 100.

As a result, it is possible to open the cap 200 by separating the same from the container 100.

In this state, in the connection portion 230, as the cutter 233 located below the trace 234 ascends, any one of both ends supporting the trace 234 is cut off so that the trace 234 is cut off, and thus, a user may visually easily check whether it is the first-time opening of the cap 200.

Thereafter, as necessary, it is possible for the user to reseal the cap 200 on the inlet 110 of the container 100 by a simple manipulation of pressing the sealing portion 210 again, and it is possible to reopen the cap 200 by repeating the above-described sequence.

Accordingly, the structure for one-touch opening/closing of a cap and a container according to the present inventive concept has advantages that productivity and assemblability of a product may be greatly improved because sealing is made by only an operation of pressing a cap that is integrally injection-molded through a simpler structure, user's convenience of use may be improved because the cap can be easily opened with one hand only, and product quality and market competitiveness may be maximized because whether the cap is opened for the first time can be easily checked.

The above-described embodiments are mere examples for explaining in detail the technical idea of the present inventive concept, and the scope of the present inventive concept is not limited to the above drawings or embodiments.

INDUSTRIAL APPLICABILITY

The present inventive concept may greatly improve productivity and assemblability of a product because sealing is made by only an operation of pressing a cap that is integrally injection-molded through a simpler structure, improve user's convenience of use because the cap can be easily opened with one hand only, and maximize product quality and market competitiveness because whether the cap is opened for the first time can be easily checked.

The invention claimed is:

1. A structure for one-touch opening/closing of a cap and a container, the structure comprising:

the container comprising an inlet and an engaging ledge formed on an outer circumferential surface thereof; and the cap comprising a sealing portion and a cover portion, the sealing portion comprising a hook member formed thereon corresponding to the engaging ledge, and opening the inlet of the container while ascending and closing the inlet of the container while descending as the hook member is put on the engaging ledge, the cover portion being formed as a barrel-shaped body for accommodating the sealing portion therein, wherein the cap further comprises a connection portion that is integrally molded by connecting the sealing portion and the cover portion, the connection portion comprises:

a thin deformable member capable of folding deformation, and a thick turning member that is thicker than the thin deformable member, the thick turning member is connected to an upper end of the cover portion and elastically deforms the cover portion outwardly during opening of the cap, and the thin deformable member has a recessed groove for inducing deformation formed therein to allow the connection portion to be folded and caught inside the cover portion inwardly in a radial direction.

2. The structure of claim 1, wherein the cover portion comprises a small diametric portion having an inner circumferential surface to restrict a maximum displacement with respect to deformation of the hook member outwardly in a radial direction, and a large diametric portion having an inner circumferential surface greater than the small diametric portion.

3. The structure of claim 2, wherein the cover portion comprises a support member in which a groove and a rail are formed to restrict the maximum displacement with respect to the deformation of the hook member outwardly in the radial direction to differ according to a vertical location relative to the sealing portion.

4. The structure of claim 3, wherein:

the hook member of the sealing portion comprises a pair of wing hooks formed apart from each other in a form of a cantilever, a cross-link connecting the pair of wing hooks, and a center hook located in a middle of the cross-link, the support member of the cover portion comprises a pair of locking rails corresponding to the pair of wing hooks and a support rail located in a middle of the pair of locking rails to correspond to the center hook, a locking groove for accommodating an end edge of the wing hook is formed in the locking rail, and a support groove for accommodating an end edge of the center hook is formed in the support rail.

5. The structure of claim 4, wherein a center protrusion capable of plastic deformation corresponding to the support groove protrudes from a lower end of the center hook.

6. The structure of claim 5, wherein:

a sealing lip and a sealing rail are provided on a bottom surface of the sealing portion to be in contact with inside and outside of the inlet of the container, respectively, and a wing handle for gripping with a finger protrudes from a lower outer circumference of the cover portion.

7. The structure of claim 6, wherein:

an upper step having a step-like cross-section is formed at an upper edge of the sealing portion along an entire circumference thereof, and a sealing hook is formed on the cover portion corresponding to the upper step, and a support ring protrudes from under the engaging ledge of the container along an entire outer circumferential surface thereof, and a stopper corresponding to the support ring protrudes from an inner circumferential surface of the cover portion.

* * * * *